US005921783A

United States Patent [19]

Fritsch et al.

[11] Patent Number: 5,921,783

[45] Date of Patent: Jul. 13, 1999

[54] ELECTROMECHANICAL CONNECTION DEVICE

[75] Inventors: Klaus-Dieter Fritsch, Am Wiesenrain 16, D-89522 Heidenheim, Germany; Achim Bullinger, Buigenstrasse 50, D-89542 Herbrechtingen, Germany; Hermann Neidlein, Heidenheim, Germany

[73] Assignees: Klaus-Dieter Fritsch, Heidenheim; Achim Bullinger, Herbrechtingen, both of Germany

[21] Appl. No.: 08/875,827

[22] PCT Filed: Jul. 18, 1995

[86] PCT No.: PCT/EP95/02812

§ 371 Date: Sep. 29, 1997

§ 102(e) Date: Sep. 29, 1997

[87] PCT Pub. No.: WO96/31924

PCT Pub. Date: Oct. 10, 1996

[30] Foreign Application Priority Data

Apr. 1, 1995 [DE] Germany ..... 195 12 334

[51] Int. Cl.[6] ..... H01R 11/30

[52] U.S. Cl. ..... 439/38; 439/700

[58] Field of Search ..... 439/38, 39, 40, 439/180, 188, 246, 289, 507, 510–514, 700, 919, 923, 955; 335/84, 103, 136, 205–207, 229–234, 255, 259, 261, 285

[56] References Cited

U.S. PATENT DOCUMENTS

| | | | |
|---|---|---|---|
| 3,431,428 | 3/1969 | Van Valer | 439/39 |
| 3,521,216 | 7/1970 | Tolegian | 439/39 |
| 3,808,577 | 4/1974 | Mathauser | 439/39 |
| 4,317,969 | 3/1982 | Riegler et al. | 439/39 |
| 4,874,316 | 10/1989 | Kamon et al. | 439/923 |

FOREIGN PATENT DOCUMENTS

WO 92/16002 9/1982 Germany .

*Primary Examiner*—Neil Abrams
*Assistant Examiner*—Brian J. Biggi
*Attorney, Agent, or Firm*—Welsh & Katz, Ltd.

[57] ABSTRACT

The invention concerns an electromechanical connection device comprising a switching device which can be connected to a current source via power supply contacts and comprises switching magnets. A tripping device, provided with tripping magnets, can be connected to the switching device. Switching magnets are thus moved from a rest position, against a restraining force, into an operating position, the contact between pairs of contacts and hence the electrical connection between the switching device and the tripping device being established. The switching magnets and the tripping magnets are provided with a special code. The pairs of contacts are disposed at least approximately in a region of the housing between the center thereof and the switching magnets. An electrically conductive bridge is provided on the operating slide for the contact between the pairs of contacts and the power supply contacts.

13 Claims, 3 Drawing Sheets

Fig.5
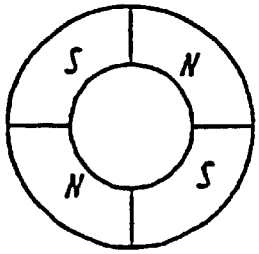
Fig.6
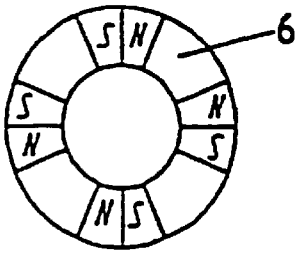
Fig.7
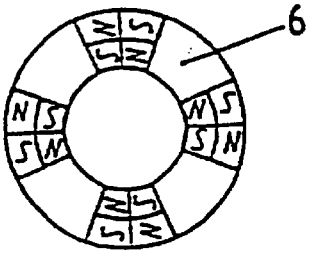
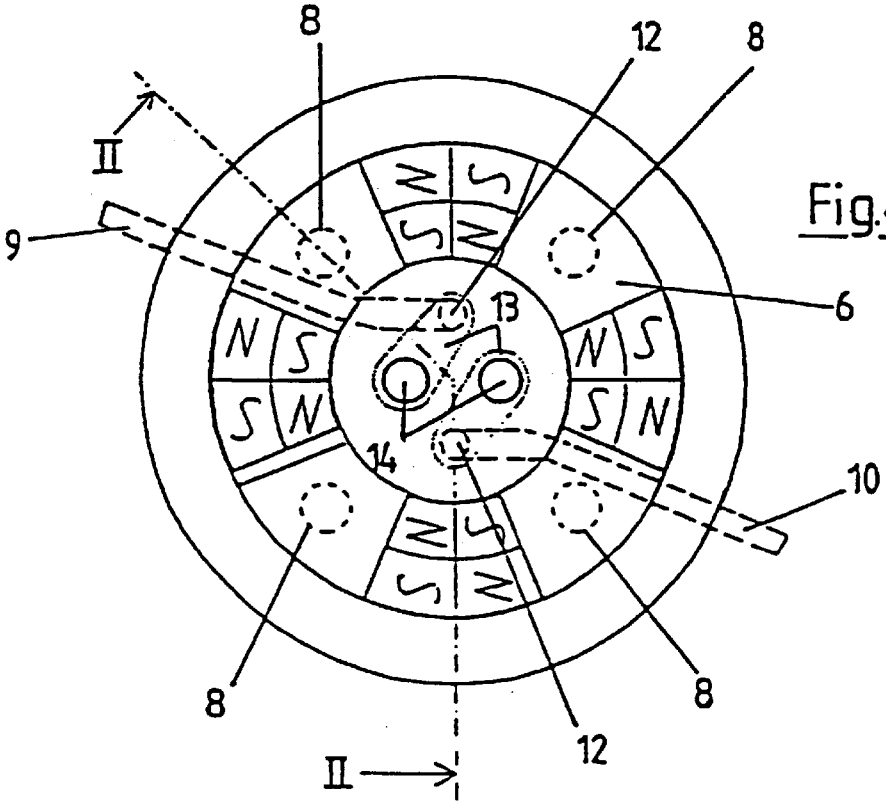
Fig.4

ELECTROMECHANICAL CONNECTION DEVICE

BACKGROUND OF THE INVENTION

The present invention relates to an electromechanical connecting device having magnets to urge electrical contacts into a conducting relation, but in which the magnets do not themselves actually conduct the electrical current.

A predecessor connecting device is described in EP 0 573 471 B1. The previously known connecting device, which consists of a switching mechanism that functions as a conventional socket-outlet and a tripping mechanism that functions as a plug, provides a connecting device which exhibits a very small overall depth and meets high safety requirements.

In the electromechanical connecting device according to EP 0 573 471 B1, both the mechanical and the electrical contact are performed via magnets. Accordingly, both the operating slide, which can be connected to power supply contacts, and the actuating magnet are electrically conductive. The power connection is led directly via contact points to tripping magnets in the tripping mechanism, which are likewise electrically conductive. The magnets are surrounded by an earthing (or grounding) ring which is flush with the insulating housing of the switching mechanism. A disadvantage of this arrangement, however, is that in the case of a short circuit electrical conduction causes damage to the heat-sensitive magnetic assemblies. Moreover, because of the conduction of voltage and current through both the contact points and magnets, the previously known device is still of relatively wide construction.

SUMMARY OF THE INVENTION

It is therefore an object of the present invention to improve the electromechanical connecting device mentioned at the beginning, and in particular to ensure greater reliability and to increase the magnetic adhesion.

It is a further object of the invention that the magnets no longer participate in the conduction of current or voltage. Rather, the current is conducted solely by contact pairs. Thus only an electrically conductive bridge is required for the operating slide to conduct current, the slide producing contact between the power supply contacts through the bridge. The operating slide itself can be electrically non-conductive, as can be the actuating magnets arranged thereon.

A further object of the invention is to increase the reliability of the device by arranging the contact pairs in the inner region. The contact pairs can be constructed to be more stable and thus more reliable, by, for example, being constructed in the form of wide contact pins.

A further object of the invention is to reduce heat problems that arise with the magnets. This object is achieved because the magnets no longer participate in current conduction—should a short circuit occur, the magnets will not be damaged by heat. Moreover heat which is produced by a possible film of moisture can be dissipated in a simple way via the earthing ring, as shown and described herein, when the actuating magnets and the tripping magnets are in contact with the earthing ring when the present invention is in the connected state.

A further very advantageous refinement of the invention is that the operating slide is constructed at least approximately in a circular fashion, and that a plurality of actuating magnets are spaced from one another in the outer circumferential region of the operating slide.

If the magnets are arranged in this case in appropriate codings, for example in alternating north-south combinations having 180° symmetry, a very rapid return of the operating slide is achieved during cycles of the tripping mechanism. The relatively large angular lengths which occur in this case give rise even in the event of small rotations to fields of opposite polarity and thus to correspondingly high repulsion forces, with the result that the operating slide returns to the non-connected rest state.

These and other objects of the present invention will become apparent from the description that follows.

BRIEF DESCRIPTION OF THE DRAWINGS

In the drawings,

FIG. 4 is a top view of the present invention;

FIG. 5 is a possible coding sequence for the magnets in the present invention;

FIG. 6 is a possible coding sequence for the magnets in the present invention;

FIG. 7 is a possible coding sequence for the magnets in the present invention;

DESCRIPTION OF THE PREFERRED EMBODIMENTS

The electromechanical connecting device comprises a switching mechanism 1, which replaces the function of the conventional socket-outlet and is generally permanently installed at a desired point, and of a tripping mechanism 2 which replaces the function of a conventional plug. As soon as an electrically conductive connection is produced between the switching mechanism 1 and the tripping mechanism 2, the tripping mechanism 2 is supplied with current.

In principle, the switching mechanism 1 and the tripping mechanism 2 are constructed using the same principle as for the electromechanical connecting device described in EP 0 573 471 B1. Thus, the switching mechanism 1, comprises a closed assembly in a two-part housing 3.

Figure 1:
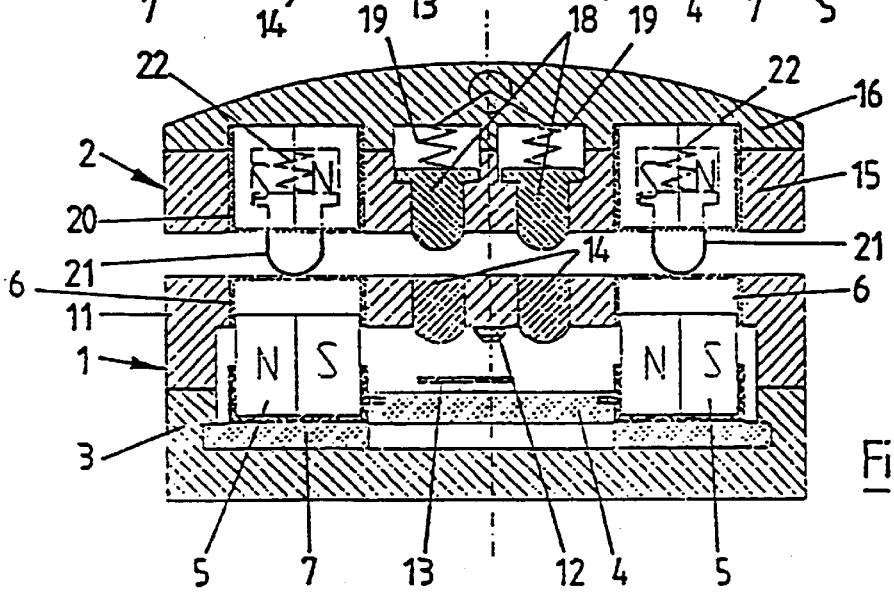
FIG. 1 is a longitudinal cross-section of the present invention, showing the switching mechanism and the tripping mechanism in the non-connected state.
Figure 2:
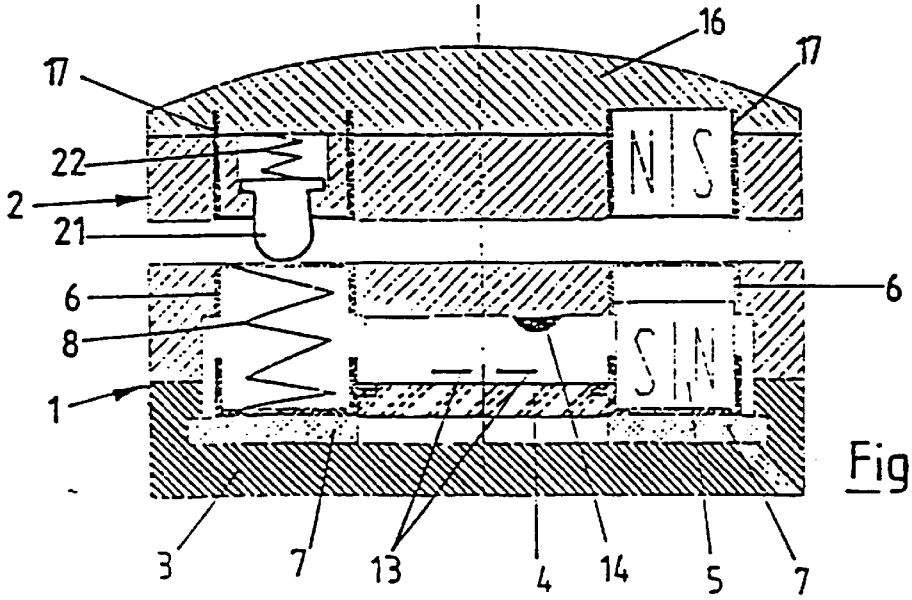
FIG. 2 is a longitudinal cross-section of the present invention along the line II—II of FIG. 4.

In the rest state as shown in FIG. 1 the tripping mechanism 2 is not placed on the switching mechanism 1. In the rest state, an operating slide 4, on which actuating magnets 5 are arranged in the form of magnet parts having different polarities, is held on the floor of the housing 3 by a ferromagnetic retaining plate 7. The ferromagnetic retaining plate can also be a magnet ring 7.

The actuating magnets are arranged in the outer circumferential region of the circular operating slide 4. Referring to FIG. 4, the actuating magnets 5, constructed as magnetically coded magnet parts in accordance with drawings FIGS. 1 to 4 and FIG. 7, are arranged along the circumference in a total of four quad groups. Each group thus consists of four coded magnets 5*a* to 5*d* each having two north poles and two south poles which are arranged relative to one another in such a way that in each case different polarities adjoin one another. This means that in the outer region a south pole and a north pole are situated next to one another, and in the inner region a north pole and a south pole face one another.

Each group having the magnet parts 5*a*, 5*b*, 5*c* or 5*d* coded in this way is thus arranged in the interior of the switching mechanism 1, and exhibits a height such that even in the non-connected state they are guided in a guide ring 6 at least in their upper region. For this purpose, they dip appropriately in the upper region into the guide ring 6. The guide ring 6 simultaneously constitutes an earthing ring, for which purpose it is connected correspondingly to a contact mechanism (not represented) which is connected to an earthing conductor which ends in the switching mechanism.

Four resetting springs 8 arranged uniformly along the circumference ensure that in the nonconnected state the operating slide 4 is additionally held on the magnet ring 7 by an appropriate spring force. At the same time, they ensure that after removal of the tripping mechanism 2 from the switching mechanism 1, or appropriate rotation of the two parts relative to one another, the operating slide 4 is brought to bear against the magnet ring 7 again. As may be seen from FIGS. 2 and 4, the resetting springs 8 are likewise guided in the guide ring 6. They are respectively located in this arrangement in free spaces between the actuating magnets.

The power supply is seen most clearly in FIG. 4. Numeral "9" represents a current-conducting phase line, and numeral "10" represents a neutral conductor line. The two lines are led on the inside of a cover 11 of the housing 3 to power supply contacts 12. In the connected state, an electrically conductive bridge 13 respectively produces a power connection from the power supply contacts 12 to the corresponding contact pin 14. This means that one contact pin 14 is assigned to the phase line 9, and the second contact pin 14 is assigned to the neutral conductor 10. Both contact pins 14 are arranged in the cover 11 of the housing 3 and are flush on the top side with the cover.

Figure 3:
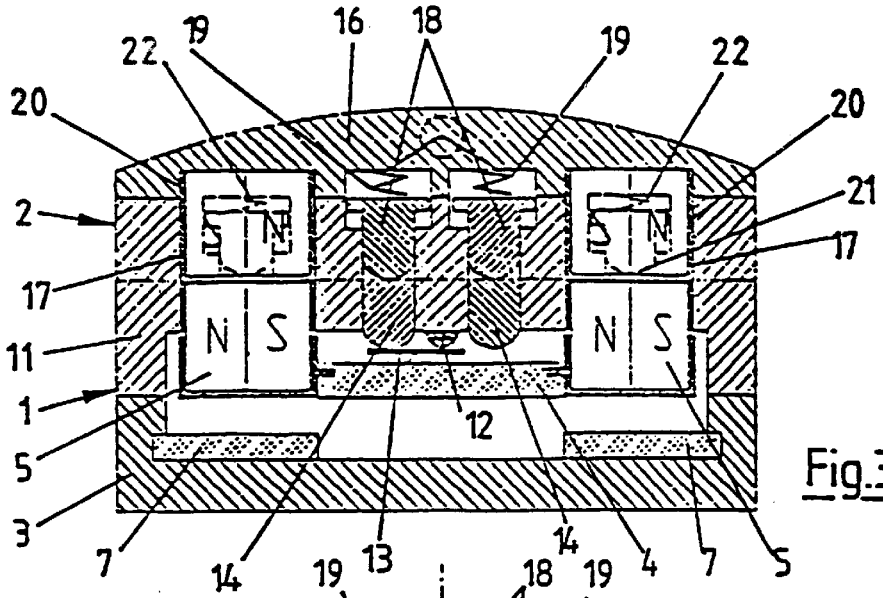
FIG. 3 is a longitudinal cross-section of the present invention, showing the switching mechanism of FIG. 1 in the connected state.

It may be seen from FIGS. 1 and 3 that each of the two bridges 13 is arranged elastically or resiliently on the operating slide 4, in order to compensate for tolerance inaccuracies as well as for wear, with the result that good contact is always ensured.

The tripping mechanism 2, which likewise exhibits a closed housing 15 with a cover 16, is provided with tripping magnets 17 which are likewise in each case formed from coded magnet parts. The tripping magnets 17 are arranged in the same way and at the same points in four quad groups in accordance with the drawings FIGS. 1 to 4 and FIG. 7. In this arrangement, each group is constructed with reference to its polarity such that in each case different polarities face one another by comparison with the magnet parts 5*a* to 5*d* of the actuating magnets 5 of the switching mechanism 1. Thus, in the case of correct positioning of the tripping mechanism 2 on the switching mechanism 1, north and south poles respectively face one another. The desired switching state, and thus the conduction of current, are achieved in this way. For this purpose, the tripping mechanism 2 is provided with appropriate lines 26 and 27 leading to a device requiring electrical current (or load), provided that the tripping device 2 is not itself arranged directly in or on the device requiring electrical current.

Just as the contact pins 14 are arranged in a region between the middle of the housing and the actuating magnets 5, two contact pins 18 are arranged in the housing 15 in the region between the middle of the housing and the tripping magnets 17. The contact pins 18 can be displaced by springs 19 in bores of the housing 15 in such a way that they project slightly with their front ends from the housing 15 in the direction of the switching mechanism 1. This means that when the tripping mechanism 2 is supported on the switching mechanism 1, as in the case of electrical contact switching, there is appropriate reliable contact (see FIG. 3). In this case, the contact pins 18 are correspondingly pushed back against the force of the spring 19.

The tripping mechanism 2 is likewise provided with an earthing ring 20, which faces the earthing ring 6 of the switching mechanism 1. In addition, the earthing ring 20 of the tripping mechanism 2 is provided with earthing pins 21, which are arranged distributed over the circumference and are each biased by a spring 22 and thus project resiliently from the housing in the direction of the switching mechanism 1.

As may be seen from FIG. 1, in this arrangement the earthing pins 21 project further from the surface of the housing 15 than the contact pins 18. This achieves a leading and a lagging earthing during switching in a simple way.

In a way similar to the resetting springs 8 of the tripping mechanism 1, the earthing pins 21 are located in the interspaces, on the circumferential side, between the four tripping magnets 17.

As may be seen from FIG. 4, the power supply contacts 12 are located in a region between the middle of the housing and the actuating magnets 5 or the guide ring 6. In this way, not only is an electromechanical connecting device produced which has a small overall depth, but, in addition, a device is also produced which exhibits only a small diameter or width.

As has been mentioned, the earthing ring 6 serves simultaneously as guide ring for the actuating magnets 5, for which purpose said ring surrounds the actuating magnets 5 with an appropriately slight play or tolerance. Reliable and non-jamming switching is ensured in this way.

Various exemplary embodiments for the actuating magnets 5 and the tripping magnets 17 are represented in FIGS. 5 to 7.

In accordance with FIG. 5, a total of only four magnets are arranged on the operating slide 4 in quarter rings. The tripping magnets 17 of the tripping mechanism correspondingly have the opposite polarity on the circular segments.

According to FIG. 6, a north pole and a south pole are combined respectively to form an actuating magnet 5. A total of four actuating magnets are arranged uniformly over the circumference.

The best solution is achieved by means of a refinement in accordance with FIG. 7, which is also described in this form in FIGS. 1 to 4. In this case, each of the four groups comprises in each case four magnet parts 5*a* to 5*d*.

This refinement yields alternating north-south combinations having a 180° symmetry. A very rapid return of the operating slide 4 in conjunction with rotation of the tripping mechanism 2 or of the switching mechanism 1 is achieved with this refinement. Because of the large angular lengths, fields of opposite polarity are produced even in the event of small rotations, as a result of which the operating slide 4 returns to its rest position and thus to bearing against the magnet ring 7. In addition, the circular structure of the operating slide 4 and also of the circular housing 3 of the switching mechanism 1 and of the tripping mechanism 2 permits a very good control of the switching movement without additional guide pins. The geometrical structure is thereby also of simpler configuration. In the case of every direction of displacement or rotation, magnetic fields of opposite polarity thus reliably return the operating slide 4.

Figure 8:
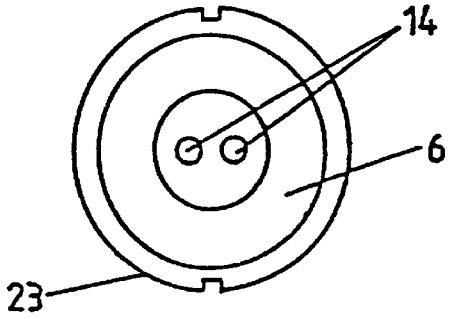
FIG. 8 is a top view of an adapter (to a reduced scale)
Figure 9:
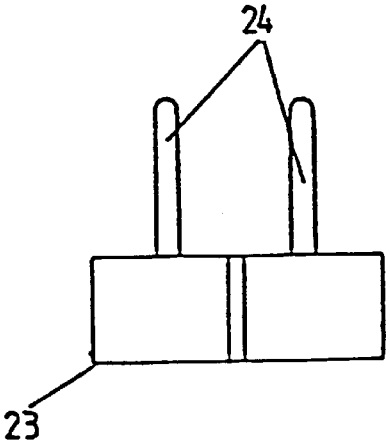
FIG. 9 is a side view of the adapter according to FIG. 8.

An adapter 23 which permits a transition to the conventional electric system with socket-outlets with earthing contacts, or else with other socket-outlets., is represented in principle in FIGS. 8 and 9. For this purpose, the adapter 23 has pins 24 corresponding to the respective conventional system (and, if appropriate, an earthing pin as well), which are plugged into the corresponding socket-outlet of known design.

The adapter 23 is constructed in the interior in the same way as the tripping mechanism 1, only the lines 9 and 10 being replaced by the pins 24. The earthing ring 6 together with the two contact pins 14 seen in FIG. 8.

Figure 10:
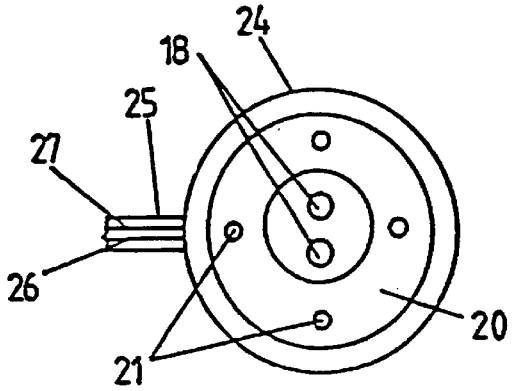
FIG. 10 is a top view of a tripping mechanism in the form of a plug (to a reduced scale)
Figure 11:
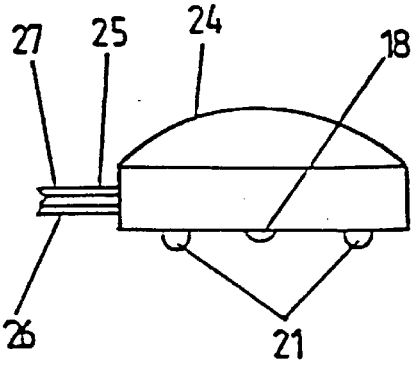
FIG. 11 is a side view of the plug according to FIG. 10.

FIGS. 10 and 11 show a separate tripping mechanism 2 in the form of a plug 24 which is provided with leads 26 and 27 which lead to a device requiring electrical current, and are surrounded in the usual way with a protective sheath 25. The plug 24 is constructed in the interior in the same way as the tripping mechanism 2. The earthing ring 20 together with four earthing pins 21 can be seen in FIG. 10.

We claim:

1. An electromechanical connecting device for connecting a load to a power source comprising:

a) a tripping mechanism, having i) a tripping magnet assembly composed of first individual magnets disposed in an array of a specific polarity, and ii) tripping mechanism contact elements electrically connectable to the load;

b) a switching mechanism connectable to the tripping mechanism having i) a housing with (1) power supply contacts to connect to the power source, (2) switching mechanism contact elements capable of being electrically connected to the tripping mechanism contact elements, ii) a operating slide encased in the housing, having (1) an actuating magnet assembly composed of second individual magnets disposed in an array opposite in polarity to the first individual magnets, thereby moving the operating slide by attraction to the tripping magnet assembly, (2) contact bridges capable of being electrically connected to the power supply contacts and to the switching mechanism contact elements, (3) a rest position where the power supply contacts and the switching mechanism contact elements are electrically separated, and (4) a working position where the contact bridges electrically connect the power supply contacts and the switching mechanism contact elements, and iii) restoring means to return the operating slide to the rest position when the tripping magnet assembly is not attracting the actuating magnet assembly;

wherein, when the tripping mechanism is brought into proximity with the switching mechanism such that the tripping magnet assembly attracts the actuating magnet assembly, an attractive force moves the operating slide into the working position from the resting position, and the tripping mechanism contact elements electrically connect with the switching mechanism contact elements, resulting in an electrical pathway from the power source to the load.

2. The electromechanical device according to claim 1, wherein the housing has a middle and the power supply contacts are arranged at least approximately in a region of the housing between the middle of the housing and the actuating magnet assembly, the contact bridges being constructed as an electrically conductive support on the operating slide.

3. The electromechanical connecting device according to claim 1, wherein the operating slide, is constructed approximately in a circular fashion, and a plurality of actuating magnet assemblies are arranged with a spacing from one another in an outer circumferential region.

4. The electromechanical connecting device according to claim 3, wherein the switching mechanism and tripping mechanism are constructed approximately in a circular fashion with a plurality of switching magnet assemblies of second individual magnets are distributed over a circumferential region of the switching mechanism and a plurality of tripping magnet assemblies of first individual magnets are distributed over a circumferential region in the tripping mechanism.

5. The electromechanical connecting device according to claim 4, wherein the individual magnets are arranged in alternating north-south combinations having 180° symmetry.

6. The electromechanical connecting device according to claim 4, wherein each magnet assembly is constructed as a quad group having individual magnets of different polarity, each quad group consisting of two north-pole and south-pole segments and south and north poles respectively facing one another radially and tangentially.

7. The electromechanical connecting device according to claim 1, wherein resetting springs producing the retaining force for the actuating magnets are guided in the guide ring.

8. The electromechanical connecting device according to claim 1, wherein the contact elements are constructed as contact pins in the switching mechanism and in the tripping mechanism.

9. The electromechanical connecting device according to claim 8, having a side facing the switching mechanism, wherein, in the non-connected state, the contact pins in the tripping mechanism project from the side facing the switching mechanism and the contact pins are mounted resiliently in the tripping mechanism.

10. The electromechanical connecting device according to claim 1, further comprising:

a) an earthing conductor to ground electrical current;

b) a tripping mechanism earthing ring on the tripping mechanism capable of being electrically connected to the load; and c) a switching mechanism earthing ring on the switching mechanism capable of being electrically connected to the earthing conductor, and capable of being electrically connected to the tripping mechanism earthing ring.

11. The electromechanical connecting device according to claim 10, wherein projecting from the earthing ring of the tripping mechanism, are resiliently mounted earthing pins which are flush with the surface of the earthing ring in the connected state.

12. The electromechanical connecting device according to claim 10 wherein the switching mechanism earthing ring simultaneously serves as a guide ring for the actuating magnet assembly.

13. The electromechanical connecting device according to claim 1 further comprising:

a) a guide ring for the actuating magnet assembly.

* * * * *